US009483666B1

(12) United States Patent
Abuelma'Atti et al.

(10) Patent No.: US 9,483,666 B1
(45) Date of Patent: Nov. 1, 2016

(54) LOGARITHMIC AND EXPONENTIAL FUNCTION GENERATOR FOR ANALOG SIGNAL PROCESSING

(71) Applicant: KING FAHD UNIVERSITY OF PETROLEUM AND MINERALS, Dhahran (SA)

(72) Inventors: Muhammad Taher Abuelma'Atti, Dhahran (SA); Noman Tasadduq

(73) Assignee: KING FAHD UNIVERSITY OF PETROLEUM AND MINERALS, Dhahran (SA)

( * ) Notice: Subject to any disclaimer, the term of this patent is extended or adjusted under 35 U.S.C. 154(b) by 0 days.

(21) Appl. No.: 14/981,786

(22) Filed: Dec. 28, 2015

(51) Int. Cl.
*G06G 7/24* (2006.01)
*G06G 7/06* (2006.01)

(52) U.S. Cl.
CPC . *G06G 7/24* (2013.01); *G06G 7/06* (2013.01)

(58) Field of Classification Search
USPC ..... 327/346–350
See application file for complete search history.

(56) References Cited

U.S. PATENT DOCUMENTS 5,585,757 A * 12/1996 Frey ..... G06G 7/24 327/348
6,744,319 B2 6/2004 Kim
7,395,308 B1 * 7/2008 Gilbert ..... G06G 7/24 708/851
8,098,102 B2 1/2012 Hase et al.
8,207,776 B1 6/2012 Gilbert
8,446,994 B2 5/2013 Rawlins et al.
8,521,802 B1 8/2013 Abuelma'atti
8,698,545 B2 * 4/2014 Larson ..... G06G 7/164 327/356
9,288,952 B2 * 3/2016 Sisson ..... A01H 5/08

OTHER PUBLICATIONS

Moshfe et al., "Design of a programmable analog CMOS rational-powered membership function generator in current mode approach," *2011 18th IEEE International Conference on Electronics, Circuits and Systems (ICECS)*, pp. 29-32, Dec. 11-14, 2011 (abstract).

* cited by examiner

*Primary Examiner* — Dinh T Le
(74) *Attorney, Agent, or Firm* — Richard C. Litman

(57) ABSTRACT

The logarithmic and exponential function generator for analog signal processing is implemented with CMOS circuits operating in current mode and includes current mirrors connected to a square root function circuit and two current amplifiers. A third current amplifier utilizes a constant current input. The outputs of the current amplifiers are combined to provide the logarithmic and exponential functions.

7 Claims, 7 Drawing Sheets

LOGARITHMIC AND EXPONENTIAL FUNCTION GENERATOR FOR ANALOG SIGNAL PROCESSING

BACKGROUND OF THE INVENTION

1. Field of the Invention

The present invention relates to function generators, and particularly to a logarithmic and exponential function generator for analog signal processing.

2. Description of the Related Art

Logarithmic and exponential function generators are widely used in analog signal processing. An exponential function generator circuit produces an output waveform (current/voltage) that is an exponential function of the input waveform (current/voltage). Such a circuit is widely used in numerous applications, such as disk drives, variable gain amplifiers, automatic gain control circuits, medical equipment, hearing aids, and other analog signal processing and telecommunication applications.

On the other hand, a logarithmic function generator circuit produces an output waveform (current/voltage) that is a logarithmic function of the input waveform (current/voltage). Such a circuit is widely used in numerous applications, such as automatic-gain control loops, and in the design of analog-to-digital converters. Moreover, combining a number of exponential and logarithmic function generators, it is possible to design a multiplier circuit. Multipliers are versatile circuits with applications in signal processing, such as adaptive filters, modulators and neural networks. Inspection of the available exponential/logarithmic function generators shows that each circuit suffers from disadvantages, e.g., very limited input range, increased complexity, and the like.

Thus, a logarithmic and exponential function generator for analog signal processing solving the aforementioned problems is desired.

SUMMARY OF THE INVENTION

The logarithmic and exponential function generator for analog signal processing is implemented with CMOS circuits operating in current mode and includes current mirrors connected to a square root function circuit and two current amplifiers. A third current amplifier utilizes a constant current input. The outputs of the current amplifiers are combined to provide the logarithmic and exponential functions.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The logarithmic and exponential function generator for analog signal processing includes current mirrors connected to a square root function circuit and two current amplifiers. A third current amplifier utilizes a constant current input. The outputs of the current amplifiers are combined to provide the logarithmic and exponential functions.

Figure 1:
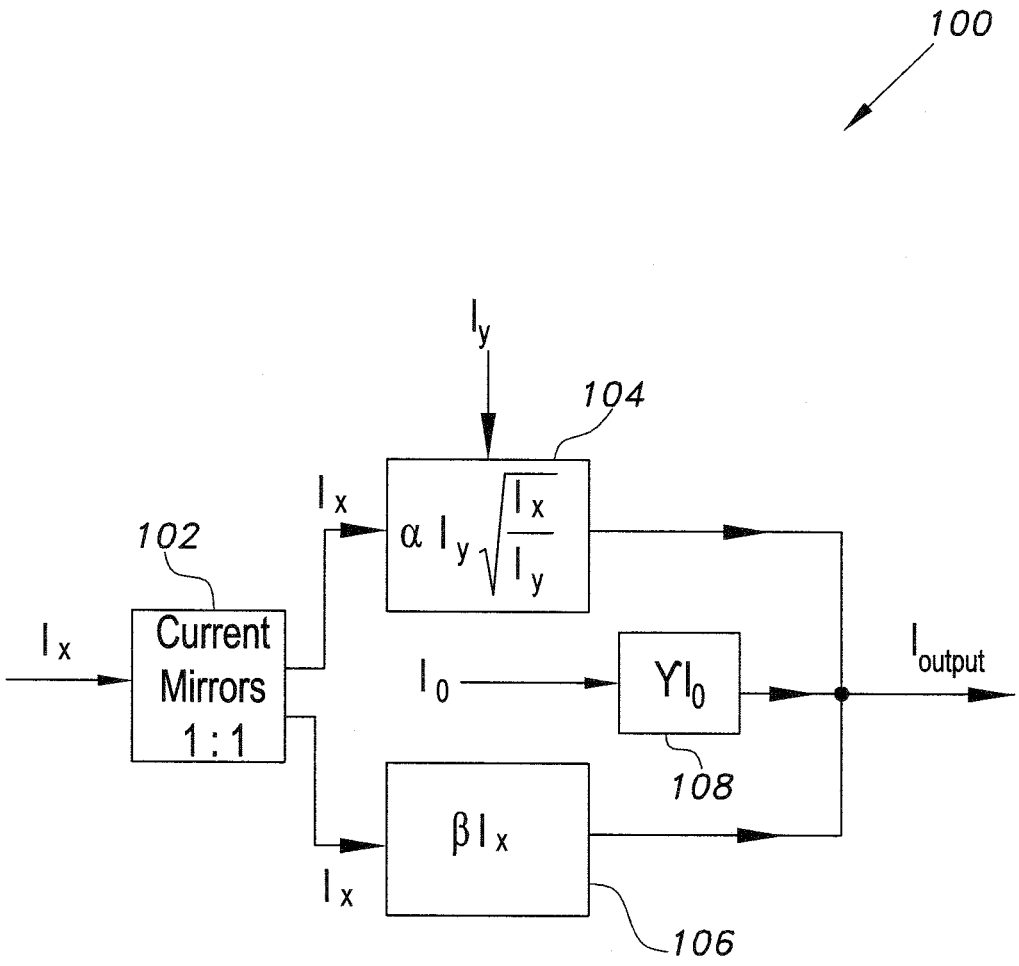
FIG. 1 is a block diagram of a model for a logarithmic and exponential function generator for analog signal processing according to the present invention.

The logarithmic and exponential function generator 100, shown in the block diagram of FIG. 1, has an input current $I_x$ injected into current mirrors 102 to produce two currents, each equal to $I_x$. The first $I_x$ current forms the input of circuit 104, comprising a square root function circuit and a current amplifier. The second $I_x$ current forms the input to a second current amplifier 106. The input to the current amplifier 108 is a DC current $I_0$. All of the current amplifiers can provide both inverted and non-inverted output currents. The current gains α, β and γ depend on the required realization. Table 1 shows the values of these current gains. The current $I_y$ is a normalizing (preferably unity) current that is required for the square root circuit 104.

TABLE 1

Values of the constants for logarithmic and exponential function generators

| Function | α | β | γ |
|---|---|---|---|
| \|ln(x)\| | 6.529 | −2.51 | −3.947 |
| Exp(−x) | −1.206 | 0.2657 | 1.311 |

The proposed implementations are based on the assumption that the logarithmic and exponential functions can be approximated by equations (1) and (2).

$$|\ln(x)|6.529\sqrt{x}-2.51x-3.947 \quad (1)$$

$$\exp(-x)\approx-0.2657\sqrt{x}+0.2657x+1.311 \quad (2)$$

Figure 2:
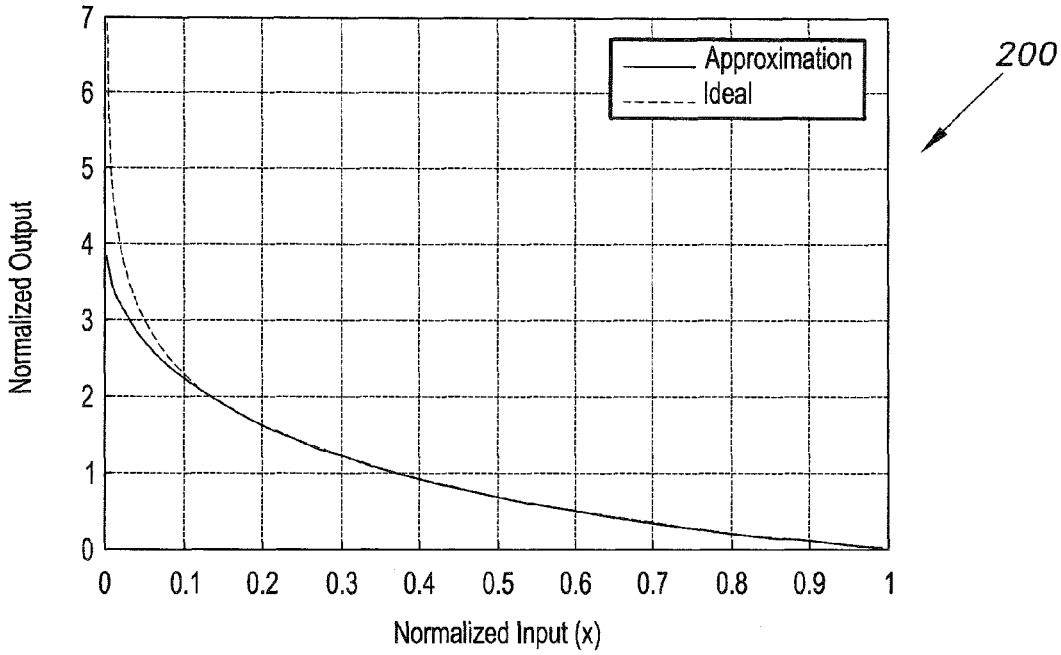
FIG. 2 is a graph comparing an ideal logarithmic function to the approximation provided by equation 1.
Figure 3:
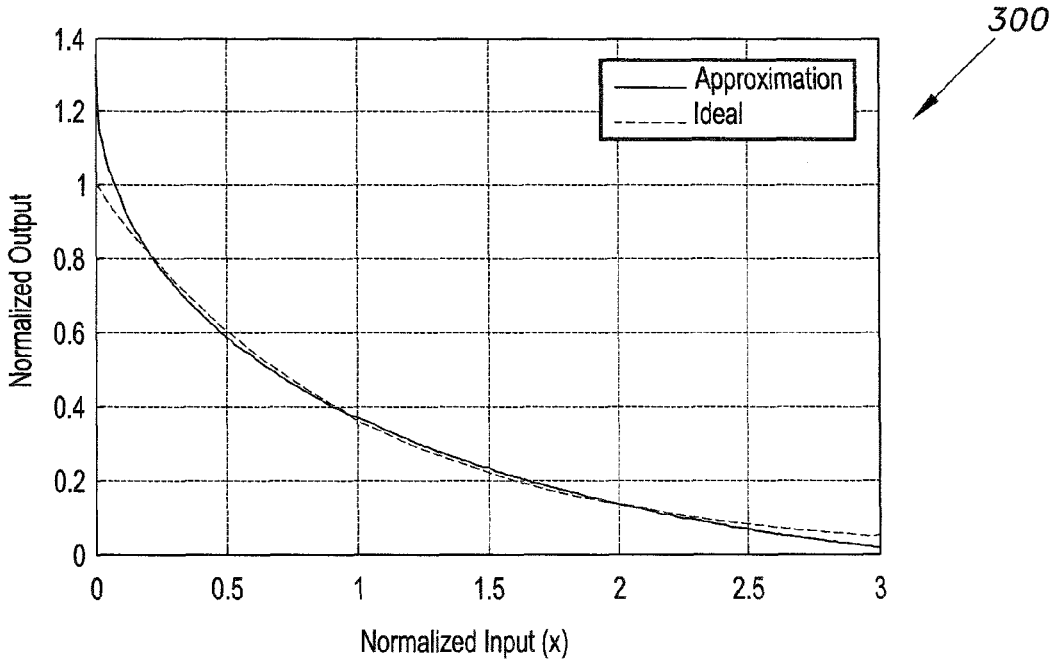
FIG. 3 is a graph comparing an ideal exponential function to the approximation provided by equation 2.

Plots 200 and 300 of FIGS. 2 and 3 show comparisons between the proposed approximations of equations (1) and (2) and the ideal performance of the logarithmic and exponential functions. Inspection of plots 200 and 300 shows that over a wide range of the normalized variable x, the approximations of equations (1) and (2) are in very good agreement with the ideal values. Tables 2 and 3 show the relative root-mean-square (RRMS) errors obtained.

TABLE 2

RRMS Error Obtained Using Equation (1) To Approximate the Logarithmic Function

| Input Range | RRMS error |
|---|---|
| 0.001 to 1.0 | 0.0755 |
| 0.01 to 1.0 | 0.0512 |
| 0.1 to 1.0 | 0.0417 |
| 0.15 to 1.0 | 0.0346 |

TABLE 3

RRMS Error Obtained Using Equation (2) To Approximate the Exponential Function

| Input Range | RRMS error |
|---|---|
| 0.01 to 3.0 | 0.0489 |
| 0.1 to 3.0 | 0.0170 |
| 0.2 to 3.0 | 0.0104 |
| 0.25 to 3.0 | 0.0101 |

Inspection of equations (1) and (2) clearly shows that the proposed realizations of the logarithmic and exponential functions use only a square root function, a linear term and a constant term.

Figure 4:
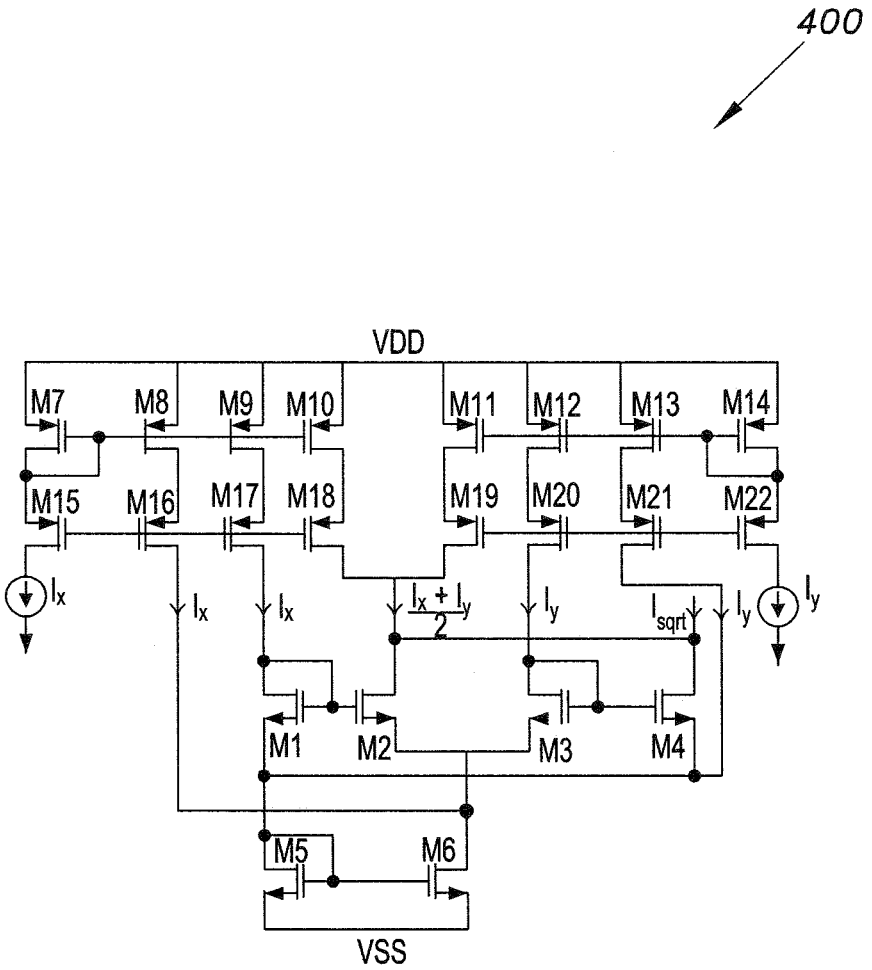
FIG. 4 is a schematic diagram of an exemplary square root circuit that may be used in a logarithmic and exponential function generator for analog signal processing according to the present invention.

In order to implement the logarithmic and exponential function generator 100, a current-mode square root circuit is required. In the open literature, there exist a large number of current-mode square root circuits. An exemplary current-mode CMOS square root circuit 400 is shown in FIG. 4. It should be understood by those of ordinary skill in the art that any other current-mode CMOS square root circuit can be used. The output of the square root circuit 400 of FIG. 4 can be expressed as:

$$I_{old}=I_y\sqrt{I_x/I_y} \tag{3}$$

Figure 5:
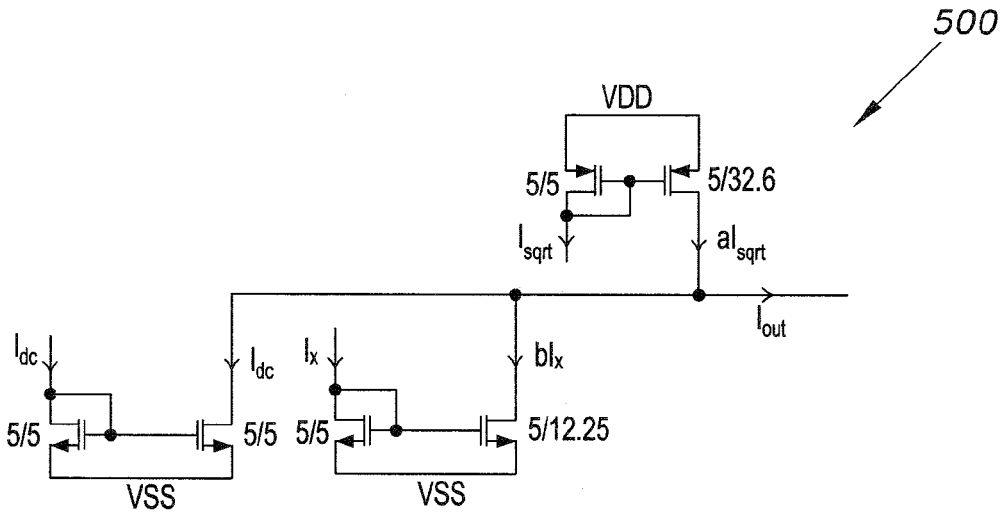
FIG. 5 is a schematic diagram of a current mirrors circuit that may be used to scale the coefficients of the logarithmic approximation function of Equation 1 in a logarithmic and exponential function generator for analog signal processing according to the present invention.
Figure 6:
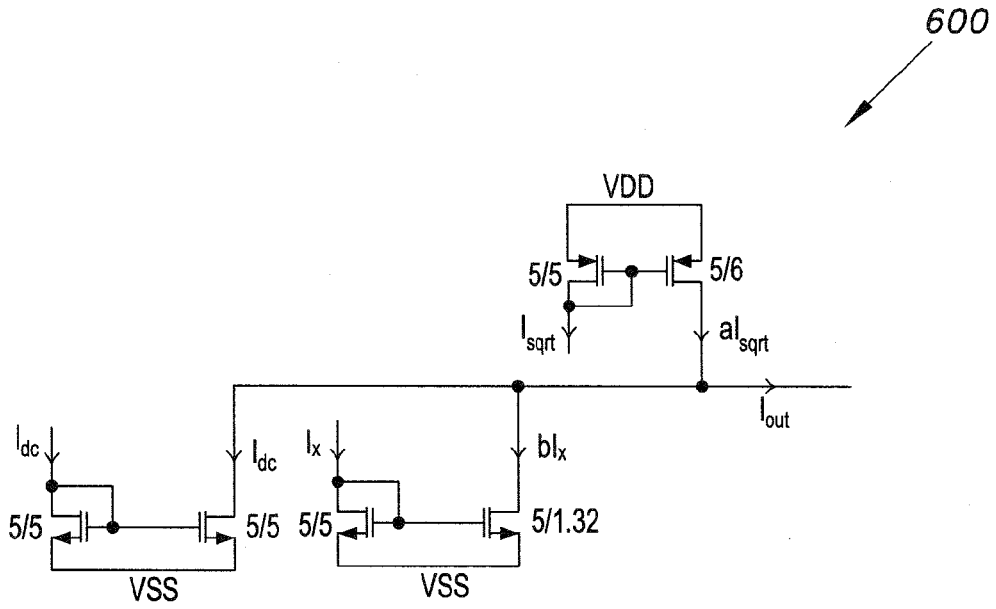
FIG. 6 is a schematic diagram of a current mirrors circuit that may be used to scale the coefficients of the exponential approximation function of Equation 2 in a logarithmic and exponential function generator for analog signal processing according to the present invention.
Figure 7:
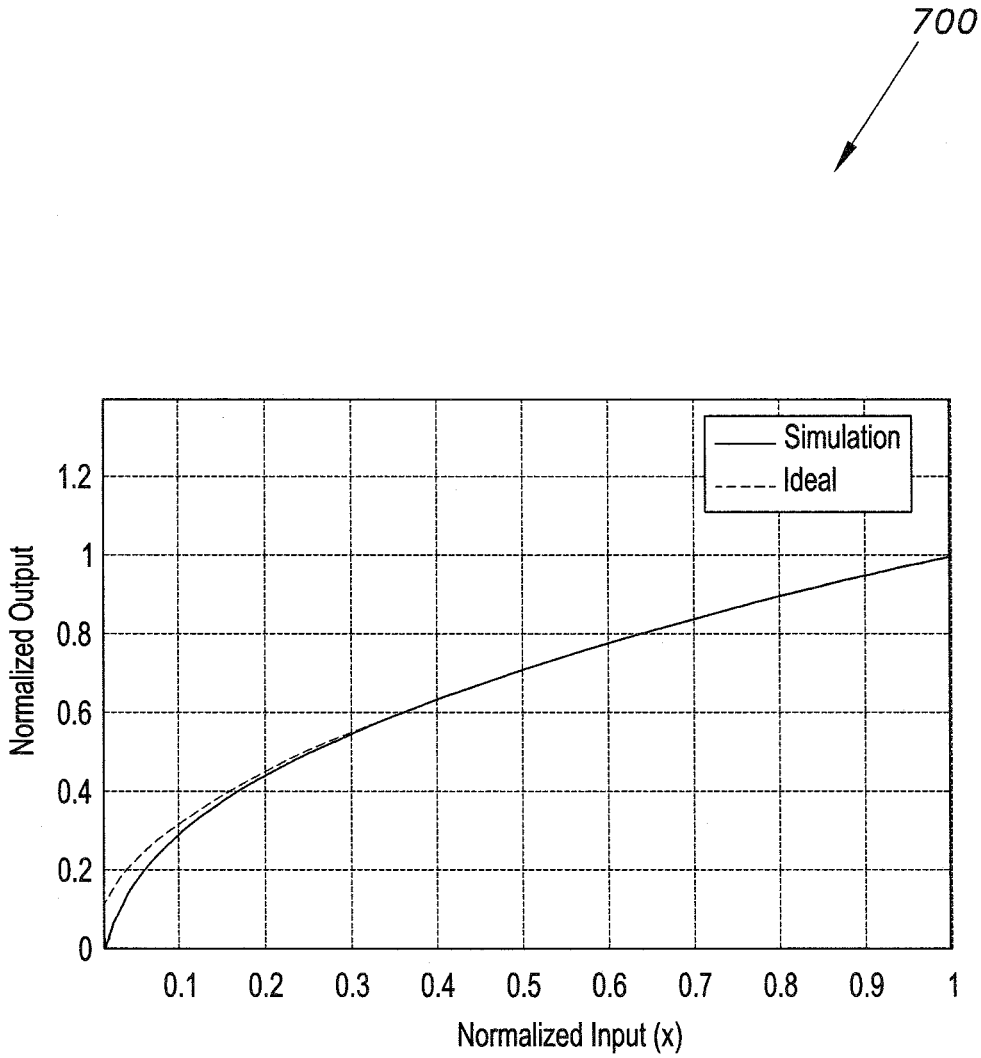
FIG. 7 is a plot of simulation results for the square root function circuit of FIG. 4 optimized for the logarithmic function of Equation 1, showing good agreement with ideal values.
Figure 8:
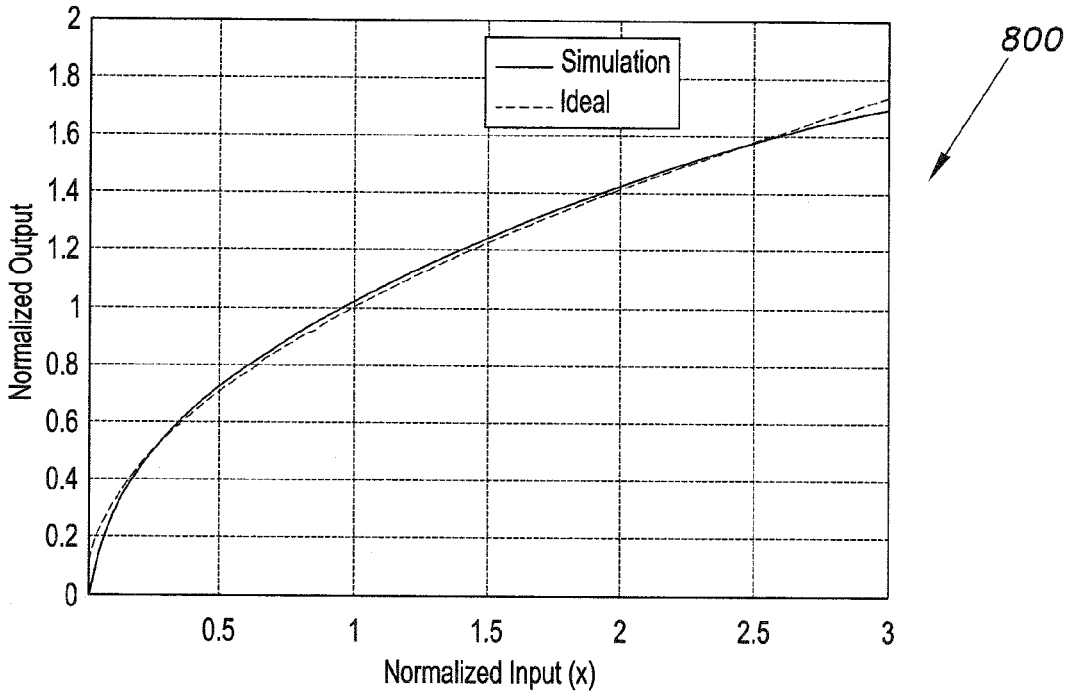
FIG. 8 is a plot of simulation results for the square root function circuit of FIG. 4 optimized for the exponential function of Equation 2, showing good agreement with ideal values.
Figure 9:
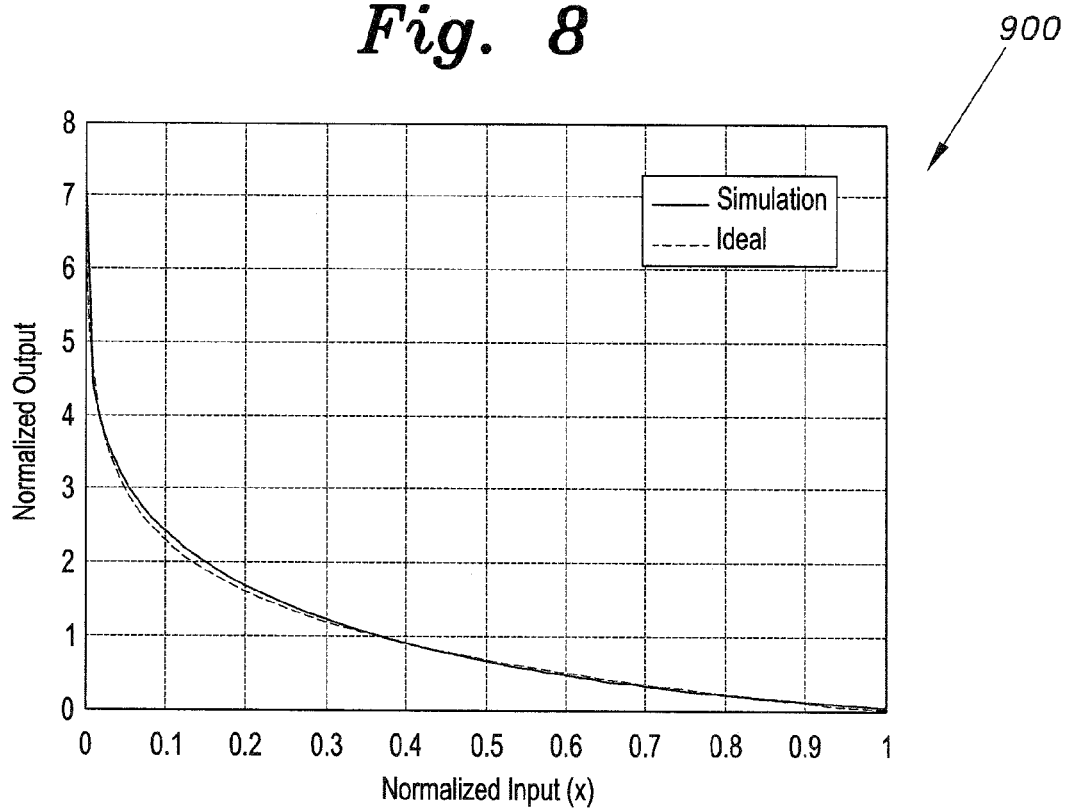
FIG. 9 is a plot of simulation results for the model circuit of FIG. 1 optimized for the logarithmic function of Equation 1, showing good agreement with ideal values.
Figure 10:
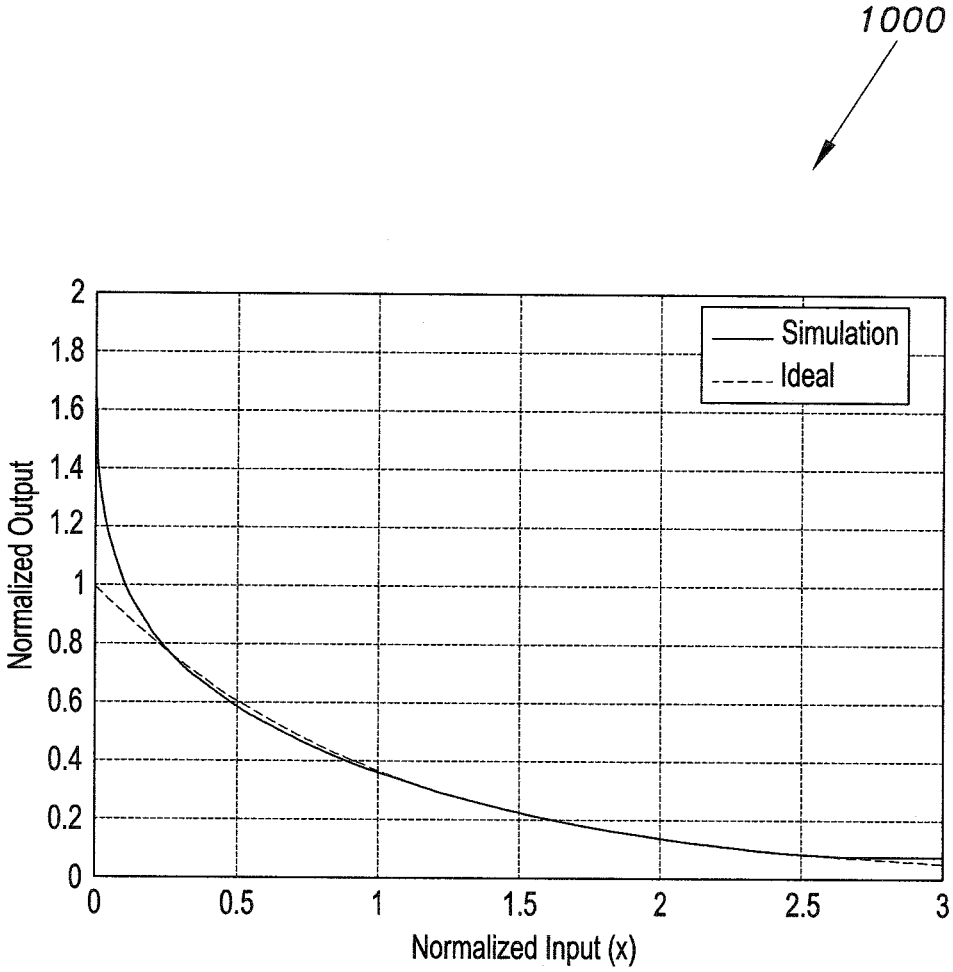
FIG. 10 is a plot of simulation results for the model circuit of FIG. 1 optimized for the exponential function of Equation 2, showing good agreement with ideal values.

The circuit 400 was optimized for realizing the logarithmic function of equation (1) and the exponential function of equation (2). A first plurality of MOSFET pairs (M7/M15, M8/M16, M9/M17, M10/M18, M11/M19, M12/M20, M13/M21, M14/M22) is configured with their sources connected to the VDD rail, and a second plurality of MOSFET pairs (M5/M6) is configured with their sources connected to the VSS rail. Interconnecting first and second pluralities of MOSFET pairs is a third plurality of MOSFET pairs (M1/M2 and M3/M4). The transistor sizes used are shown in Tables 4 and 5, respectively. In addition to the optimized square root function, the realization of equations (1) and (2) using FIG. 1 requires additional constant terms and current amplifiers. While a large number of current amplifiers are available, the present logarithmic and exponential function generator uses simple current mirrors with different aspect ratios for the transistors. In current-mode, the addition of these terms can be easily done by adding (subtracting) currents at a node, as shown in the block diagram of circuit 100 in FIG. 1. Circuits 500 and 600 of FIGS. 5 and 6 show the current amplifier circuits used in conjunction with circuit 400 of FIG. 4 to complete the circuit realizations of the logarithmic and exponential functions of equations (1) and (2), respectively. Thus, combining circuits 400 and 500, the logarithmic function of equation (1) can be realized and combining circuits 400 and 600, the exponential function of equation (2) can be realized. Using more sophisticated current amplifiers where the current gain can be controlled using a voltage (or a current) and with the availability of inverted/non-inverted output currents means that one can design a function generator that can be programmed to produce either an exponential or a logarithmic function.

The present circuits were simulated using Tanner simulation software from Tanner EDA in 0.35 micron standard CMOS technology with $I_y$=10 μA, $V_{DD}$=−$V_{SS}$=1.65 V. Tables 4 and 5 show the dimensions used for realizing the logarithmic and exponential functions.

TABLE 4

Dimensions (W/L) Of Transistors of the Square Root Circuit of FIG. 4 Optimized for Realizing Logarithmic Function of Equation (1)

| Transistor | Dimension |
|---|---|
| M1, M2, M3, M4, M5, M6 | 5μ/5μ |
| M7, M8, M9, M12, M13, M14, M15, M16, M17, M20, M21, M22 | 32μ/6μ |
| M10, M11, M18, M19 | 16μ/6μ |

TABLE 5

Dimensions of Transistors of The Square Rooter Circuit Of FIG. 2 Optimized for Realizing Exponential Function of Equation (2)

| Transistor | Dimension |
|---|---|
| M1, M2, M3, M4, M5, M6 | 5μ/3μ |
| M7, M8, M9, M12, M13, M14, M15, M16, M17, M20, M21, M22 | 24μ/3μ |
| M10, M11, M18, M19 | 12μ/3μ |

The results are shown in plots 700 through 1000 of FIGS. 7 through 10, respectively. Inspection of plots 700 (FIG. 7) and 800 (FIG. 8) shows that the simulation results obtained for the square root circuit 400 of FIG. 4 optimized for the logarithmic and exponential functions are in good agreement with the theoretical values over a wide range of the normalized input current. Similarly, inspection of plots 900 (FIG. 9) and 1000 (FIG. 10) shows that the present realization generates logarithmic and exponential functions with good accuracy over a wide range of the normalized input current. Tables 6 and 7 show the obtained RRMS errors.

TABLE 6

RRMS Error Obtained From Simulation of The Logarithmic Function Using the Circuit Built Using Equation (1)

| Input Range | RRMS error |
|---|---|
| 0.001 to 1.0 | 0.2285 |
| 0.01 to 1.0 | 0.1348 |
| 0.1 to 1.0 | 0.0161 |
| 0.15 to 1.0 | 0.0141 |

TABLE 7

| RRMS Error Obtained From the Simulation of the Exponential Function Using the Circuit Built Using Equation (2) | |
|---|---|
| Input Range | RRMS error |
| 0.01 to 3.0 | 0.0250 |
| 0.1 to 3.0 | 0.0137 |
| 0.2 to 3.0 | 0.0128 |
| 0.25 to 3.0 | 0.0129 |

In order to investigate the feasibility of integrated circuit fabrication of the present circuit, MAGIC editor has been used for obtaining the physical layout of the proposed logarithmic function. The resulting dimensions of this physical layout are about 135 um for the width and 104 um for the height.

Logarithmic and exponential function generators have been disclosed. Contrary to available realizations, the present function generators use only a square root function, a linear function and a constant value. Thus, their realization in current-mode CMOS is simple and straightforward using available square root circuit realizations. Simulation results obtained from the current-mode realizations of the present function generators show good agreement with the theoretical values over a wide range of the normalized input current.

It is to be understood that the present invention is not limited to the embodiments described above, but encompasses any and all embodiments within the scope of the following claims.

We claim:

1. A logarithmic and exponential function generator for analog signal processing, comprising:

a pair of current mirrors having an input accepting an input current $I_x$ and providing first and second output currents, both of the output currents being $I_x$;

a square root current amplifier circuit having an input accepting the first $I_x$ output current, a normalizing input accepting a current $I_y$, and providing a square root output characterized by the expression:

$$\alpha I_y\sqrt{\frac{I_x}{I_y}},$$

where α is a current gain provided by the square root current amplifier circuit;

a linear current amplifier accepting the second $I_x$ output current as input and having an output characterized by the expression:

$$\beta I_x,$$

where β is a current gain provided by the linear current amplifier;

a DC current amplifier accepting a DC current $I_0$ as input and having an output characterized by the expression:

$$\gamma I_0,$$

where γ is a current gain provided by the DC current amplifier, the outputs from the square root current amplifier circuit, the linear current amplifier, and the DC current amplifier being summed to provide a total output characterized by the expression:

$$\alpha I_y\sqrt{\frac{I_x}{I_y}}+\beta I_x+\gamma I_0,$$

where α, β and γ are selected so that the total output expression represents an approximation of a function selected from the group consisting of a logarithmic function and an exponential function.

2. The logarithmic and exponential function generator for analog signal processing according to claim 1, wherein the current gain α is about 6.529, the current gain β is about −2.51, and the current gain γ is about −3.947, the total output expression approximating a natural logarithm function according to the approximation given by:

$$|\ln(x)|6.529\sqrt{x}-2.51x-3.94,$$

where x is $I_x/I_y$, and current $I_y$ is a normalizing unity current.

3. The logarithmic and exponential function generator for analog signal processing according to claim 1, wherein the current gain α is about −1.206, the current gain β is about 0.2657, and the current gain γ is about 1.311, the total output expression approximating an exponential function according to the approximation given by:

$$\exp(-x)\approx-1.206\sqrt{x}+0.2657x+1.311,$$

where x is $I_x/I_y$, and current $I_y$ is a normalizing unity current.

4. The logarithmic and exponential function generator for analog signal processing according to claim 1, wherein said square root current amplifier circuit comprises:

a first plurality of MOSFET pairs (M7/M15, M8/M16, M9/M17, M10/M18, M11/M19, M12/M20, M13/M21, M14/M22) configured with their sources connected to a VDD rail;

a second plurality of MOSFET pairs (M5/M6) configured with their sources connected to a VSS rail; and a third plurality of MOSFET pairs (M1/M2 and M3/M4) interconnecting the first and second pluralities of MOSFET pairs.

5. The logarithmic and exponential function generator for analog signal processing according to claim 4, wherein:

MOSFETS M1, M2, M3, M4, M5, M6 have channel dimensions (W/L)=5μ/5μ;

MOSFETS M7, M8, M9, M12, M13, M14, M15, M16, M17, M20, M21, M22 have channel dimensions (W/L)=32μ/6μ; and MOSFETS M10, M11, M18, M19 have channel dimensions (W/L)=16μ/6μ, the channel dimensions facilitating logarithmic function generation.

6. The logarithmic and exponential function generator for analog signal processing according to claim 4, wherein:

MOSFETS M1, M2, M3, M4, M5, M6 have channel dimensions (W/L)=5μ/3μ;

MOSFETS M7, M8, M9, M12, M13, M14, M15, M16, M17, M20, M21, M22 have channel dimensions (W/L)=24μ/3μ; and MOSFETS M10, M11, M18, M19 have channel dimensions (W/L)=12μ/3μ, the channel dimensions facilitating exponential function generation.

7. The logarithmic and exponential function generator for analog signal processing according to claim 1, wherein the function generator comprises CMOS current amplifier circuits operating in current mode to provide the square root current amplifier circuit current gain α, the linear current amplifier current gain β, and the DC current amplifier current gain γ.

* * * * *